United States Patent [19]

Dellinger

[11] 4,246,975

[45] Jan. 27, 1981

[54] WELLBORE DRILLING TECHNIQUE USING ECCENTRIC TOOL JOINTS TO MITIGATE PRESSURE-DIFFERENTIAL STICKING

[75] Inventor: Thomas B. Dellinger, Duncanville, Tex.

[73] Assignee: Mobil Oil Corporation, New York, N.Y.

[21] Appl. No.: 26,844

[22] Filed: Apr. 4, 1979

[51] Int. Cl.[3] ..... E21B 7/06; E21B 17/02

[52] U.S. Cl. ..... 175/61; 175/325

[58] Field of Search ..... 175/61, 323, 325, 320; 166/241

[56] References Cited

U.S. PATENT DOCUMENTS

| | | | |
|---|---|---|---|
| 2,309,791 | 2/1943 | Sanders | 166/241 |
| 2,841,366 | 7/1958 | Dunn | 175/325 |
| 3,146,611 | 9/1964 | Fox | 175/320 |
| 3,306,378 | 2/1967 | Williams, Jr. | 175/325 |
| 3,382,938 | 5/1968 | Williams, Jr. | 175/325 |
| 3,391,749 | 7/1968 | Arnold | 175/61 |
| 3,642,079 | 2/1972 | Van Note | 175/325 |

OTHER PUBLICATIONS

Pressure–differential Sticking of Drill Pipe and How It Can be Avoided or Relieved, by Helmick and Longley, Shell Oil Co.

*Primary Examiner*—James A. Leppink

*Attorney, Agent, or Firm*—Charles A. Huggett; James F. Powers, Jr.

[57] ABSTRACT

A rotary method and apparatus are described to mitigate differential sticking of a drill string during the drilling of a wellbore. Eccentrically bored tool joints are used for interconnecting joints of drill pipe together into a drill string for use in drilling the wellbore. The drill string is rotated in the wellbore, causing the drill pipe to be eccentrically moved in the wellbore during the drilling operation to better remove the cuttings from the wellbore and mitigate differential sticking of the drill string.

2 Claims, 4 Drawing Figures

CONCENTRIC

ECCENTRIC

WELLBORE DRILLING TECHNIQUE USING ECCENTRIC TOOL JOINTS TO MITIGATE PRESSURE-DIFFERENTIAL STICKING

BACKGROUND OF THE INVENTION

This invention is concerned with a rotary drilling technique for mitigating pressure-differential sticking of a drill string used in drilling a wellbore. This technique is particularly applicable for drilling deviated wellbores.

Pressure-differential sticking of drill pipe is discussed in a paper entitled "Pressure-differential Sticking of Drill Pipe and How It Can Be Avoided or Relieved" by W. E. Helmick and A. J. Longley, which was presented at the Spring Meeting of the Pacific Coast District, Division of Production, Los Angeles, California, in May 1957. In this paper it is said that the theory of pressure-differential sticking was first suggested when it was noted that spotting of oil would only free pipe that had stuck while remaining motionless opposite a permeable bed. This was particularly noticeable in a field where a depleted zone at 4300 feet with a pressure gradient of 0.035 psi per foot was penetrated by directional holes with mud having hydrostatic gradients of 0.52 psi per foot. It was concluded that the drill collars lay against the filter cake on the low side of the hole and the pressure differential acted against the area of the pipe in contact with the isolated cake with sufficient force that a direct pull could not effect release. This paper notes that the methods of effecting release of the pipe are spotting oil to wet the pipe, thereby relieving the differential pressure, or washing to water to lower the differential pressure, by reducing the hydrostatic head. Field application of the principles found in a study discussed in this paper show that the best cure for differential sticking is to prevent it by use of drill-collar stabilizers and, more important, conscientiously shortening the intervals of rest when pipe is opposite permeable formations.

The use of tubular drill string members formed to have grooves along continuous paths for reducing the area of its periphery engagement with the wellbore to thereby lessen the likelihood of the members becoming stuck due to differential pressure is described in U.S. Pat. No. 3,146,611 to Fred K. Fox.

In U.S. Pat. No. 3,306,378 there is described an invention which relates to drill collars used in a drill string for boring holes to maintain a stiff stem above the drill bit in order to counteract the tendency of the drill collars to flex and corkscrew and thus to increase the drilling weight without causing deviation of the bit. The invention is carried out by providing drill collars, having an eccentric hold therethrough, that are connected by means of tool joint connections on the ends thereof with drill pipe, whereby the drill collars gyrate in continuous contact with the wall of the borehole. Two or more collars are arranged symmetrically about the axis of rotation to maintain a uniformity of support on the wall of the borehole and provide the stiffness required to maintain linear alignment of the bit with the axis of rotation. In U.S. Pat. No. 3,382,938 there is described another method for controlling deviation of a drill bit from its intended course by providing drill collars which carry a series of spaced-apart pads extending radially from one side of the collar and having faces in wiping contact with the wall of the borehole. In U.S. Pat. No. 2,841,366 there is described a method and apparatus for drilling wells which are concerned with controlling and stabilizing the drill collars and bit at the lower end of a drill string. The action of the drill collars and bit is controlled and stabilized by the provision of an eccentric weight. At a point where the drill collars tend to buckle and bend there is provided a drill collar that has generally aligned upper and lower coupling portions and an eccentric intermediate portion. The eccentric intermediate portion will swing by action of centrifugal force in a circular path around the wellbore and have wiping engagement with the side of the bore, which tends to smooth the wall of the wellbore. As the eccentric portion revolves, the aligned portions are held concentric with the central axis of the wellbore and hold the drill bit vertically disposed such that the earth is penetrated in a manner to produce a straight, vertical bore. In U.S. Pat. No. 3,391,749 there is discussed a technique for preventing a well borehole from deviating from the vertical as it is being drilled by use of a drill collar which is eccentrically weighted with respect to its axis of rotation.

In U.S. Pat. No. 2,309,791 there is described a method and apparatus for cementing casing in a well wherein the casing is pushed away from the walls of the well, and any stringers of mud which tend to remain in place as cement slurry flows upward around the casing are broken up so that the casing can be completely surrounded by cement. The casing is provided with eccentric enlargements. Either by orientation of such enlargements with respect to the casing, rotation of the casing, or by a combination of the two, the casing tends to be centered in the hole. These eccentric enlargements can be carried by or comprised of a coupling, shoe, float collar, or any fitting placed in the casing string. Rotation of the eccentric enlargements disturbs the flow of an ascending cement column, tending to force it around all of the sides of the casing.

Wellbores and wells have been drilled to extend into the earth in directions other than vertical for various reasons. A need for such wells was early recognized and still exists today for tapping mineral reserves located beneath water bodies or located beneath other poorly accessible surface locations. For example, before the turn of the century, the Summerland Field located underwater near Santa Barbara, Cal., was drilled by whipstocking holes out under the water from land locations.

More recent developments have enabled ultrahigh angle wells to be drilled and completed. Techniques for drilling ultrahigh angles are sometimes referred to as "extended reach drilling", a term that has been coined to describe rotary drilling operations used to drill wellbores greater than 60° from the vertical and wherein complex wellbore profiles may be used to extend the horizontal limits of wellbores. Such techniques may be used to provide a wellbore that extends from a surface location to a subsurface location spaced a great lateral distance therefrom.

Among the problems encountered in drilling deviated wells is that of differential sticking of drill pipe. This problem also is encountered in substantially vertical wellbores but the problem is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe when a porous formation is penetrated that has internal pressures less than the pressures existing in the borehole.

This invention is directed to alleviating the problem of differential sticking of the drill string by reducing the area of contact between the drill string and the wellbore wall and by sweeping the drill cuttings from the lower side of the wellbore into the main stream of the mud-return flow to better remove the cuttings from the wellbore.

SUMMARY OF THE INVENTION

This invention is directed to a rotary method of drilling a wellbore to mitigate differential sticking of a drill string having a drill bit at the lower end thereof. An open hole portion of the wellbore is drilled by rotating a drill string that has joints of drill pipe connected one to the other by eccentric tool joints to provide for eccentrically moving the drill pipe in the wellbore upon contact of the tool joints with the wall of the wellbore.

DESCRIPTION OF THE PREFERRED EMBODIMENTS

Figure 1:
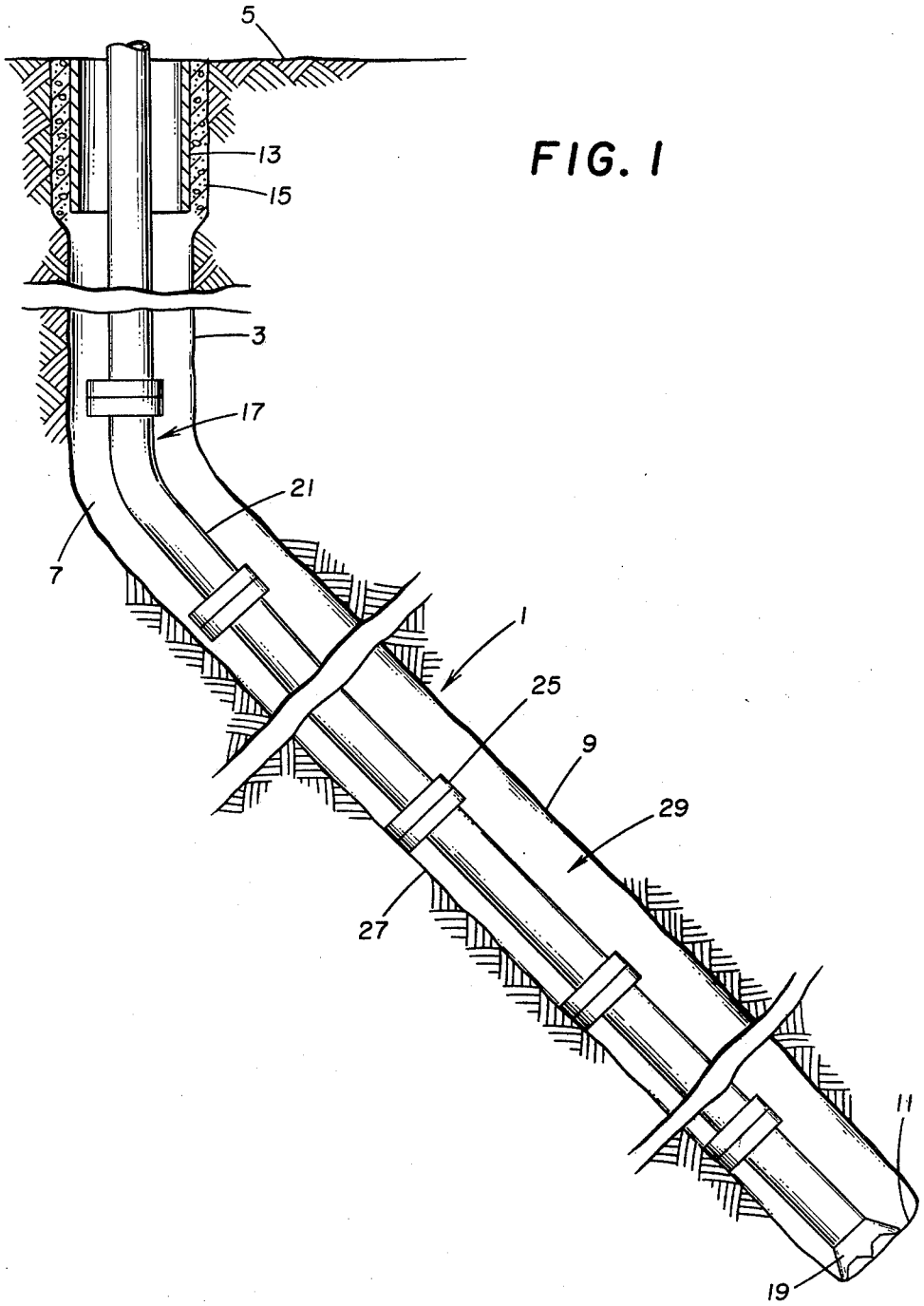
FIG. 1 is a schematic drawing of a deviated wellbore extending into the earth and illustrating the present invention.

This invention is directed to a rotary drilling technique for drilling a wellbore into the earth and is particularly applicable for drilling a deviated wellbore or and extended reach borehole into the earth.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from $3\frac{1}{2}''$ to $5''$ in outside diameter. Drill collars are thick-walled pipe as compared to drill pipe and thus are heavier per linear foot than drill pipe. The drill collars act as stiff members in the drill string. The drill collars are normally installed in the drill string immediately above the bit and serve to supply weight on the bit. In common rotary drilling techniques, only the bottom three-fourths of the drill collars are in axial compression to load the bit during drilling, while about the top one-fourth of the drill collars is in tension as is the drill pipe. The drill collars used in conducting rotary drilling techniques are of larger diameter than the drill pipe in use and normally are within the range of $4\frac{1}{2}''$ to $10''$ in outside diameter. The tool joints are connectors for interconnecting joints of drill pipe and are separate components that are attached to the drill pipe after its manufacture. A tool joint is comprised of a male half or pin end that is fastened to one end of an individual piece of pipe and a female half or box end that is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubulars, such as drill pipe, drill collars, and casing, are suspended in the hole from the rig floor. A kelly is used as a top tubular member in the drill string and the kelly passes through the rotary table and is acted upon by the rotary table to apply the torque through the drill string to the bit. Fluid or mud pumps are used for circulating drilling fluid or mud intermediate the drilling rig and the bottom of the wellbore. Normally, the drilling fluid is pumped down the drill string and out through the drill bit and is returned to the surface through the annulus formed about the drill string. The drilling fluid serves such purposes as removing earth cuttings made by the drill bit from the wellbore, cooling the bit, and lubricating the drill string to lessen the energy required in rotating the drill pipe. In completing the well, casing is normally run thereinto and is cemented to maintain the casing in place.

As previously mentioned, in the drilling of wellbores utilizing rotary drilling equipment, problems known as differential sticking of the drill string are sometimes encountered. These problems become more severe in drilling deviated wellbores inasmuch as the drill string lies on the bottom of the deviated portion of the wellbore and drill cuttings tend to settle about the drill string. Because of the drill string and cuttings lying along the bottom of the deviated portion of the wellbore, that portion of the annulus that lies above the drill string serves as the main stream for the flow of the drilling mud and cuttings to the surface of the earth.

This invention is directed to mitigating the differential sticking of a drill string by preventing the drill pipe from lying directly against the lower side of the wellbore and by eccentrically moving the drill string, and in particular the drill pipe, about the wellbore to stir or sweep the drill cuttings from the lower side of the wellbore into the main stream of flow of the drilling mud to better remove the cuttings therefrom.

By this invention there is provided a method of drilling a wellbore into the earth's crust by a rotary drilling technique wherein a drill string is used to advance a drill bit into the earth's crust and a drilling fluid is circulated down the drill string, out the drill bit, and returned from the wellbore via the annulus formed about the drill string. In the drilling of such a wellbore it is usual after drilling the first few hundred or few thousand feet to install and cement in place a first string of casing often referred to as "shallow or surface casing" and thereafter to continue drilling the wellbore in an open hole. Subsequent strings of casing may be run and cemented into place and drilling continued in an open hole below such casing. In accordance with this invention, a drill string is used in the open hole portion of the wellbore which is comprised of joints of drill pipe connected together with nonconcentric or eccentric connectors known as and hereafter referred to as eccentric "tool joints".

This invention is particularly applicable for drilling a deviated wellbore. In the drilling of a deviated wellbore by the method of this invention, there is drilled a vertical first portion of the wellbore into the earth's crust from a surface location to a kick-off point at about the lower end of the first portion by rotating and advancing a drill string and drill bit into the earth's crust and a deviated second portion of the wellbore is initiated at the kick-off point. Thereafter, the drill string and drill bit are withdrawn from the wellbore. Casing may be installed and cemented therein as desired. A specialized drill string is then run into the vertical first portion of the wellbore for drilling the deviated second portion thereof, which specialized drill string is comprised of joints of drill pipe connected one to the other with eccentric tool joints to provide for the body of the drill pipe to be nonconcentric with the tool joints, which drill string has a drill bit connected at the lower end thereof. The specialized drill string is rotated to drill the deviated second portion of the wellbore and to eccentrically move the drill pipe in the wellbore to sweep earth cuttings from the lower side of the deviated second portion thereof and to prevent differential sticking of the specialized drill string in the wellbore.

The eccentric portion of the tool joints may be positioned along the drill pipe in a random manner. In accordance with one embodiment of this invention, the drill pipe is connected one joint to the other with eccentric tool joints arranged in alternate pairs, with each pair having the eccentric of one tool joint thereof in angular alignment with the eccentric of the other tool joint and with each alternate pair being aligned such that the eccentric of the tool joints of the alternate pair is aligned about 180° with the eccentric alignment of the next adjacent alternate pair of tool joints. In accordance with another embodiment of this invention, all of the eccentrics of the tool joints are aligned one with the other along the drill pipe.

This invention is hereafter described in more detail by reference to the drawings. With reference to FIG. 1 there is shown a deviated wellbore 1 having a vertical first portion 3 that extends from the surface 5 of the earth to a kick-off point 7 and a deviated second portion 9 of the wellbore which extends from the kick-off point 7 to the wellbore bottom 11. A shallow or surface casing string 13 is shown in the wellbore surrounded by a cement sheath 15. A drill string 17, having a drill bit 19 at the lower end thereof, is shown in the wellbore 1. The drill string 17 is comprised of drill pipe 21 and the drill bit 19, and will normally include drill collars (not shown). The drill pipe 21 is comprised of joints of pipe that are interconnected together by eccentric tool joints 25. Eccentric tool joints may be used to connect the joints of drill pipe located in the vertical first portion 3 of the wellbore extending in the open hole portion thereof below the casing 13 as well as in the deviated second portion 9 of the wellbore. The eccentric tool joints 25 in the deviated second portion 9 of the wellbore rest on the lower side 27 of the wellbore and support the drill pipe 21 above the lower side 27 of the wellbore.

In drilling of the wellbore, drilling fluid (not shown) is circulated down the drill string 17, out the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21. The eccentric tool joints 25 rest on the lower side 27 of the wellbore and support the drill pipe 21 above most of these cuttings. During drilling operations, the drill string 17 is rotated and the rotation of the eccentric tool joints 25 causes the drill pipe 21 to be eccentrically moved in the wellbore. This movement of the drill pipe 21 tends to sweep the drill cuttings (not shown) from the lower side of the wellbore 27 into the main stream of flow of the returning drilling fluid in the annulus 29, and in particular into that part of the annulus which lies around the upper side of the drill pipe 21, where they are better carried by the returning drilling fluid to the surface of the earth. The main stream of flow is illustrated schematically by an enlarged wellbore about the upper side of the drill pipe 21 and drill bit 19. The use of the eccentric tool joints 25 in the manner described by this invention mitigates the problem of differential sticking of the drill string by eccentrically moving the drill pipe 21 in the wellbore and by keeping the wellbore clean.

Figure 2:
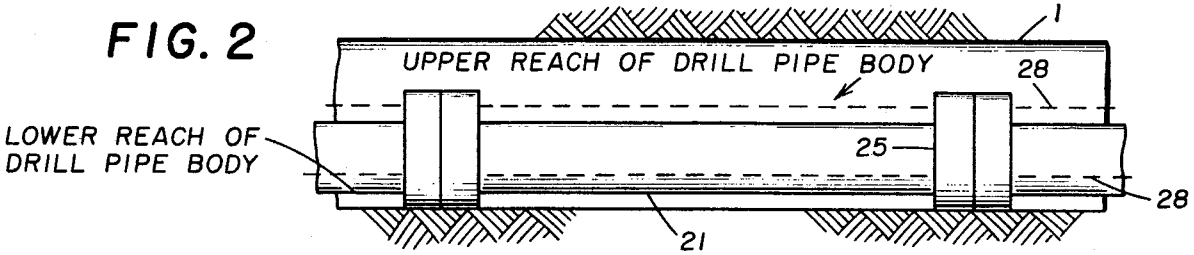
FIG. 2 is a schematic drawing illustrating joints of drill pipe interconnected by eccentric tool joints and positioned along the lower side of a deviated portion of a wellbore.

With reference to FIG. 2 the action of the drill pipe 21 brought about by rotation of the drill string in the wellbore 1 where joints of drill pipe are interconnected by eccentric tool joints 25 is further illustrated. There shown in solid lines is the location at the lower reach of the drill pipe 21 in a deviated portion of the borehole 1 where the joints of the drill pipe are interconnected by eccentric tool joints 25 and where adjacent tool joints 25 are aligned such that the eccentric portions of the adjacent tool joints are in angular alignment and where the eccentric tool joints are rotated in the borehole 1 to provide for the drill pipe 21 to be at the lowest position of the pipe body. The dotted lines 28 show the position of the drill pipe body 21 when the eccentric tool joints 25 are rotated such that the body of the drill pipe is at the highest position in the deviated portion of the wellbore 1. From this FIG. 3 it is readily seen that, upon rotation of the drill pipe 21 interconnected with eccentric tool joints in a deviated wellbore, the drill pipe 21 moves upwardly and downwardly in the borehole 1 with each successive rotation of the drill string.

Figure 3B:
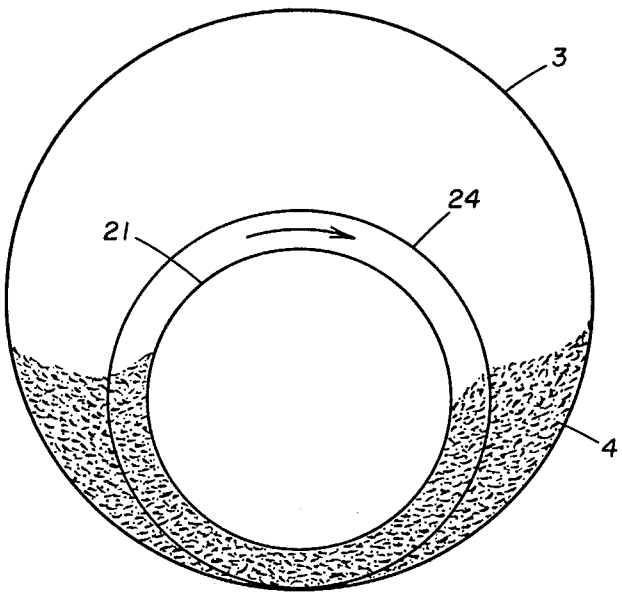
FIGS. 3A and 3B show schematic cross-sectional views of drill pipe connected by eccentric and concentric tool joints and illustrate the wellbore-cleaning effects of the present invention.
Figure 3A:
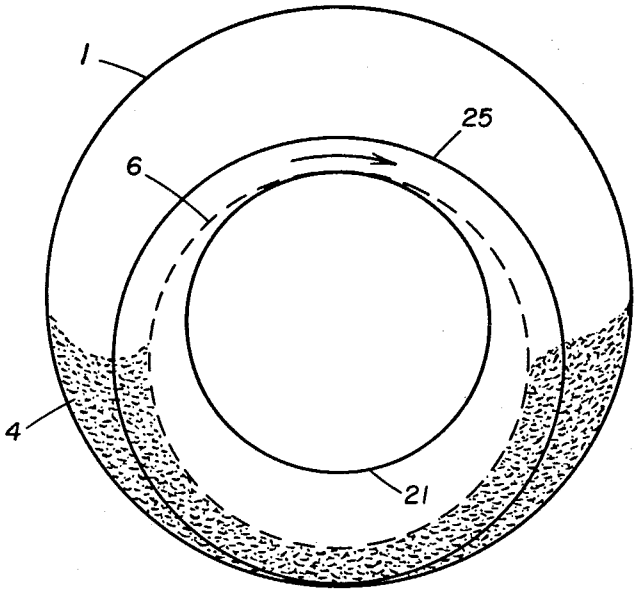

With reference to FIGS. 3A and 3B, there is shown schematically the movement which would take place upon rotation in a borehole of a drill pipe interconnected by eccentric joints as compared to the movement which drill pipe would take in a borehole by rotation of the drill pipe interconnected by concentric tool joints. With reference first to FIG. 3A, there is shown the case where eccentric tool joints are used. There shown is a cross-sectional schematic view in a wellbore 1 having drill pipe 21 located therein and interconnected by eccentric tool joints 25. Drill cuttings 4 are shown in the lower side of the borehole 1 which indicate how the drill cuttings accumulate along the lower side of a deviated borehole. The dotted line 6 shows a trace that the drill pipe 21 would follow during the rotation of the drill pipe interconnected by eccentric tool joints 25. The position of the drill pipe 21 as represented by the solid circle corresponds to the position of FIG. 2 where the drill pipe body is located at the upper reach of the pipe body.

With reference to FIG. 3B, the drill cuttings 4 are again shown in the borehole 1. The drill pipe 21 is shown in concentric, axial alignment with concentric tool joints 24 of the type generally used in conducting rotary drilling techniques. By comparison of these two figures it is seen that the use of eccentric tool joints results in movement of the drill pipe 21 along an eccentric path 6 upon rotation of the tool joints and drill pipe which results in stirring and sweeping drill cuttings 4 from the lower portion of the wellbore and results in continually moving the drill pipe eccentrically upward and downward in the borehole 1. This movement of the pipe tends to stir and sweep the drill cuttings 4 into the flowing mud stream in the annulus of a wellbore and thereby better removes these cuttings from the wellbore. The removal of the cuttings from the wellbore greatly lessens the chance of differentially sticking the drill pipe. In FIG. 3B there is shown, in contrast, the normal situation where concentric tool joints are used with drill pipe.

I claim:

1. A method of drilling a deviated wellbore into the earth's crust by a rotary drilling technique wherein a drill string is used to advance a drill bit into the earth's crust and a drilling fluid is circulated down the drill string and returned from the wellbore in the annulus formed about the drill string, comprising:

(a) drilling a vertical first portion of said wellbore into the earth's crust from a surface location to a kick-off point at about the lower end of said first portion by rotating and advancing a drill string and drill bit into said earth's crust;

(b) initiating a deviated second portion of said wellbore at said kick-off point;

(c) withdrawing said drill string and drill bit from said vertical first portion of said wellbore;

(d) running into said vertical first portion of said wellbore a specialized drill string for drilling said deviated second portion of said wellbore, said specialized drill string being comprised of joints of drill pipe connected one to the other with eccentric tool joints to provide for the body of the drill pipe to be nonconcentric with said tool joints, said drill string having a drill bit at the lower end thereof; and (e) rotating said specialized drill string to drill said deviated second portion of said wellbore and to eccentrically move said drill pipe in said wellbore to sweep earth cuttings from the lower side of said deviated second portion of said wellbore to prevent differential sticking of said specialized drill string in said wellbore.

2. The method of claim 1 wherein said specialized drill string is comprised of joints of drill pipe connected one to the other with eccentric tool joints arranged in alternate pairs, with each pair having the eccentric of one tool joint thereof in angular alignment with the eccentric of the other tool joint and each alternate pair being aligned such that the eccentric of the tool joints of said alternate pair is aligned about 180° with the eccentric alignment of the next adjacent alternate pair of tool joints.

* * * * *